US006231482B1

(12) United States Patent
Thompson

(10) Patent No.: US 6,231,482 B1
(45) Date of Patent: May 15, 2001

(54) SYSTEM FOR CLIMBING TRAINING

(75) Inventor: James F. Thompson, West Bountiful, UT (US)

(73) Assignee: Ascent Products, Inc., Bozeman, MT (US)

( * ) Notice: Subject to any disclaimer, the term of this patent is extended or adjusted under 35 U.S.C. 154(b) by 0 days.

(21) Appl. No.: 09/355,550

(22) PCT Filed: Oct. 20, 1997

(86) PCT No.: PCT/US97/18819

§ 371 Date: Nov. 22, 1999

§ 102(e) Date: Nov. 22, 1999

(87) PCT Pub. No.: WO98/32496

PCT Pub. Date: Jul. 30, 1998

(51) Int. Cl.[7] ..... A63B 7/00
(52) U.S. Cl. ..... 482/37
(58) Field of Search ..... 482/1–8, 900, 482/901, 902, 903, 37, 57, 51

(56) References Cited

U.S. PATENT DOCUMENTS 5,125,877 * 6/1992 Brewer ..... 482/7
5,478,295 * 12/1995 Fracchia ..... 482/902
5,549,195 * 8/1996 Aulagner et al. ..... 482/37
5,916,063 * 6/1999 Alessandri ..... 482/4
5,919,117 * 7/1999 Thompson et al. ..... 482/37
6,042,519 * 3/2000 Shea ..... 482/57
6,053,844 * 4/2000 Clem ..... 482/8
6,059,692 * 5/2000 Hickman ..... 482/8

* cited by examiner

*Primary Examiner*—Stephen R. Crow
(74) *Attorney, Agent, or Firm*—Roth & Goldman

(57) ABSTRACT

A climbing trainer comprising a movable climbing training wall surface defined by a continuous belt rotatably disposed about a pivotable frame and controllably actuated to rotate at a selected speed, the pivotable frame and support being selected to provide a desired inclination of the climbing training wall within a range including positive inclinations and negative inclinations; the movement of said wall surface and inclination of said pivotable frame being controllable by electronic means; and wherein a wall controller comprising a microprocessor controls said trainer to provide a climb simulation having a plurality of segments of different difficulty; said differing difficulty being facilitated by alteration of at least one parameter of a group of parameters consisting of vertical distance of wall surface movement, speed of wall surface movement, inclination of said wall surface, and designation of particular holds affixed to said wall surface as available and unavailable; said simulating being a compilation of instructions for said wall controller which can be transferred to the wall controller from elsewhere via a data link, and may be transferred via a global computer network.

11 Claims, 17 Drawing Sheets

12
108
110
14
90
76
68
78
90
69
66
67
66
64
96
24
50
66
56
54
82
66
52
66
86
20
66
88
84
66
42
83
33
40
44
60
48
38
58
66
62
30
80
72
46
70
74
80
32
66
108
34
14
110

108
90
14
76
68
69
12
58
64
67
66
58

FIG. 9A
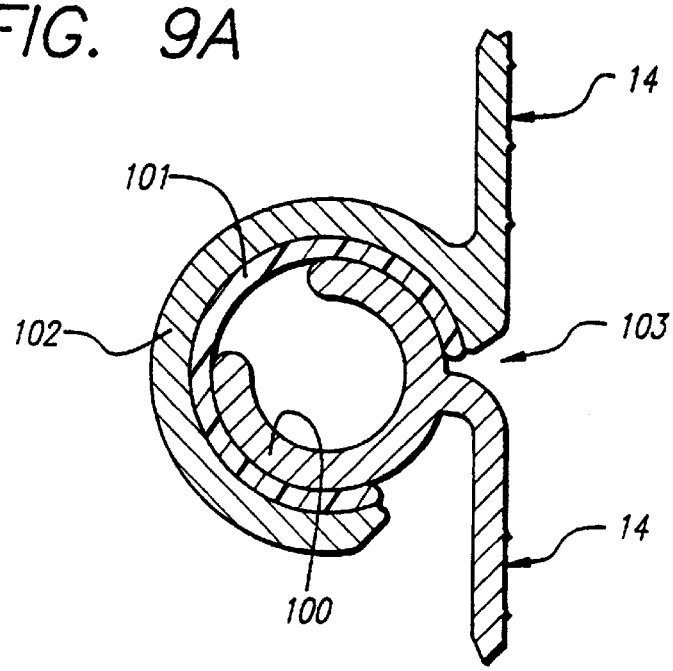
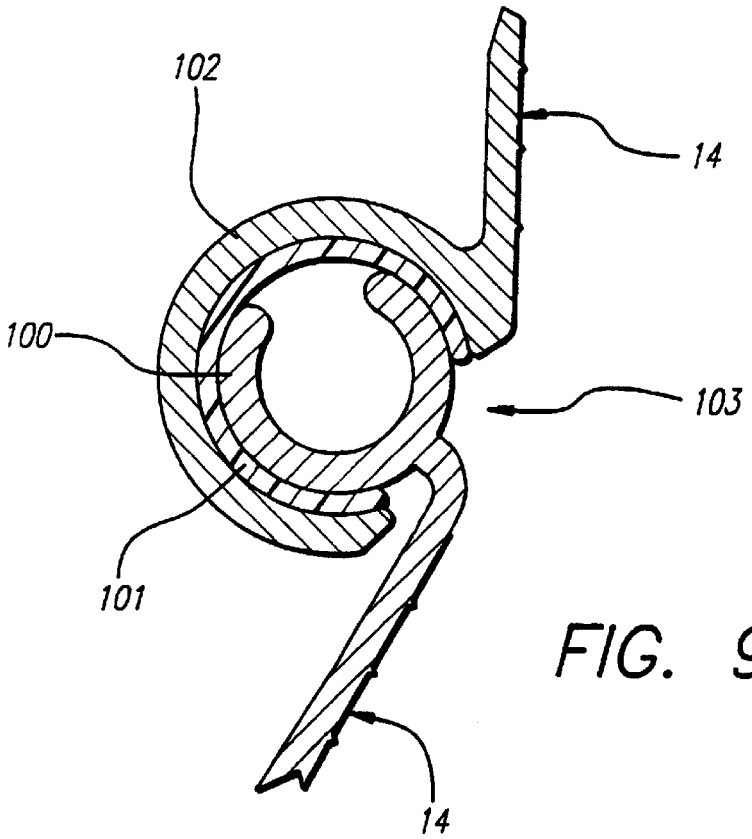
FIG. 9B

SYSTEM FOR CLIMBING TRAINING

BACKGROUND OF THE INVENTION

1. Field of the Invention

The present invention relates generally to climbing training equipment. The invention relates more particularly to a climbing wall training apparatus of the type having a continuous rotating wall surface adapted for climbing.

2. Description of the Related Art

In providing training opportunities for climbers it has been recognized that man-made climbing surfaces located in convenient locations are advantageous. Accordingly many stationary climbing wall surfaces have been constructed throughout the world so as to be accessible to climbers. In order to provide satisfactory training, relatively high stationary climbing walls are usually required. These involve a very large structure, and if enclosed and isolated from the weather, a further large structure is required for this isolation purpose as well. These later considerations limit the places where climbing walls of this type can be located.

Provision of a continuous rotating wall surface allows the climbing training wall to be greatly reduced in height, and in effect can provide a simulation of ascending any height desired by sufficient rotation of the continuous wall surface. Moreover, such a reduction in size allows climbing training in existing buildings of conventional design without extensive modification. Moreover, greatly reduced cost characterizes such training apparatus when compared with necessarily large stationary walls. Safety is enhanced as the climber does not ascend to a great height and belay or other provisions to prevent falls of dangerous extent need not be required. Usually only a simple safety mat to cushion such short falls as may be experienced need be provided.

Difficulties in providing such a continuous rotating climbing surface for training have been encountered. Particularly, known devices generally do not provide a great deal of adjustability in positive and/or negative inclination. Some training walls have characteristics making training less effective, for example undesired play or give in the climbing surface due to deflections of components of the device under stresses applied during use.

Moreover, generally the rotating climbing wall of prior equipment was either fixed or required manual adjustment of the angle of inclination of the climbing surface. The user generally is required to stop climbing and either make adjustments or wait for others to make them before continuing climbing at a different angle of inclination. This interrupts training and decreases the similarity of training to a real climb is therefore undesirable.

These difficulties having been recognized, the present invention is directed to providing, at a reasonably low cost, a climbing training apparatus with improved operational characteristics.

SUMMARY OF THE INVENTION

The present invention accordingly provides a climbing trainer comprising:

a support frame;

a pivoting frame having first and second ends and a pivot axis intermediate the first and second ends, the pivoting frame being pivotably supported by the support frame allowing relative rotational movement about the pivot axis between the pivoting frame and the support frame;

a pivot actuator selectively allowing and preventing relative rotational movement between the support frame and the pivoting frame about the pivot axis and rotationally moving said pivoting frame with respect to said support frame whereby the inclination of said pivoting frame can be selectively fixed;

a movable climbing training wall surface comprising a continuous belt having an outer surface adapted to incorporate climbing holds, said continuous belt being carried by and rotatable about said pivoting frame, the continuous belt being restrained from movement transverse to a plane of the climbing training wall surface so as to resist forces tending to pull climbing holds incorporated in the outer surface of the continuous belt away from the wall surface and those tending to push said holds towards the wall surface, the climbing training wall surface being moveable in a direction parallel to a plane defined by the training wall surface by rotation of the continuous belt about said pivoting frame, said continuous belt being formed of a plurality of interlinked panels hinged together so as to be in force transmitting contact along the hinges between panels so as to transfer forces other than moment forces about axes parallel to an axis of rotation of a hinged connection between panels;

a first spindle;

a second spindle, said first and second spindles rotatably carried by the pivot frame at the first and second ends respectively of said pivot frame and rotatable about two parallel axes, the continuous belt comprising said climbing training surface being disposed about said spindles and bending about said two parallel axes, and wherein the continuous belt is stiffened to resist bending about a further axis orthogonal to said two parallel axes about which the first and second spindles rotate, and an wall surface actuator adapted to rotate said continuous belt about the pivoting frame, whereby the climbing training wall surface is moved to provide a simulated climb, the inclination of the climbing training wall surface being adjustable by rotation of the pivotable frame over a range of inclinations including negative inclinations.

In a more detailed aspect, the continuous belt comprising said climbing training surface being disposed about said spindles and bending about said two parallel axes is stiffened to resist bending about a further axis orthogonal to said two parallel axes about which the first and second spindles rotate. In a further detailed aspect the continuous belt further comprises a multiplicity of rotatably interlinked panels, each being rotatable with respect to another about an axis parallel to said two parallel axes about which said first and second spindles rotate, and configured to mitigate unintentional engagement of the training wall surface with things which would otherwise be caught and moved with said wall surface by minimizing opening and closing of voids between said rotationally interlinked panels. The climbing trainer can further comprise at least one interchangeable hold releasably affixed to one of said rotationally interlinked panels.

In another detailed aspect the actuator can comprise a variable speed motor coupled to at least one of said first and second spindles, said climbing trainer further comprising a speed control operable from said continuous climbing surface, said speed control being adapted to vary the speed of the motor. Moreover, the climbing trainer can include an emergency safety kill switch operable from said continuous climbing training surface and adapted to stop movement of said belt about said pivoting frame and can also stop relative rotational movement between said pivoting frame and said base frame.

In a still further more detailed aspect the rotatably interlinked panels can be extrusions having first and second sides comprising an inner hinge portion having an outer cylindrical configuration at the first side and an outer hinge portion at the second side having an inner cylindrical configuration configured to engage said inner hinge portion of an adjacent panel and cooperate to provide a hinge between adjacent panels. The rotatably interlinked panels can be formed of a metal or metal alloy comprising aluminum.

In another more detailed aspect the continuous belt defines an inner surface and first and second ends, said belt being slidably connected to said pivoting frame by at least one connection between said pivoting frame and said inner surface intermediate the first and second ends of the belt, and wherein said connection allows relative movement of the frame and continuous belt in a direction parallel to a plane defined by the climbing training wall surface and restricts movement in a direction orthogonal to said plane, whereby said continuous belt is restricted from movement orthogonal to said plane defined by the climbing wall surface by at least one sliding connection to the pivoting frame intermediate the first and second edges of the belt.

In a further detailed aspect the climbing trainer further comprises a wall controller which controls the pivot actuator and wall surface actuator, said wall controller having a memory, whereby data comprising a climb simulation is storable in said controller and said controller initiates timed movements of said pivot actuator and said wall surface actuator to provide a climb simulation. The climbing trainer may further comprise a data link whereby data comprising a climb simulation can be transferred to said wall controller. Moreover, data comprising said climb simulation can be transferred via a computer network from a remote site.

In another detailed aspect the climbing trainer can further comprise a personal computer connected to said wall controller via said data link, said data being transferred from said personal computer to said wall controller via said data link. The climbing simulation can be stored on a memory device accessible by said personal computer. The personal computer can be connected to a computer network and said data comprising the climbing simulation can be transferred to said personal computer via said network from a storage site located elsewhere on said network. In further detail, data comprising a climb simulation can be used by said wall controller to simulate a climb having a plurality of segments of different difficulty by reason of variation of at least one parameter from a group of parameters consisting of speed of wall surface movement and inclination of said pivotable frame. In this regard said range of inclinations comprises those negative inclinations between a maximum negative inclination where said climbing training wall surface is disposed horizontally facing downward and a positive inclination where said climbing training wall surface is disposed facing upward at an oblique angle with respect to vertical. The segments in combination can simulate a climbing route based on an actual climbing route which has been mapped and difficulties of various segments determined.

Further aspects and advantages of the invention will be appreciated by study of the drawings and the following detailed description of the preferred embodiments which are provided by way of explanation and not by way of limitation.

BRIEF DESCRIPTION OF THE DRAWINGS

FIG. 9*a* is a more detailed sectional view of a portion of the climbing wall rotationally connected extruded panels forming the rotating wall surface illustrating details of the hinge connection between panels when the panels are positioned on a vertical face of the rotating climbing wall surface.

FIG. 9*b* is a more detailed sectional view of a portion of the climbing wall rotationally connected extruded panels forming the rotating wall surface illustrating details of the hinge connection between panels when the panels are positioned on a spindle at an end of the rotating inner frame.

DESCRIPTION OF THE PREFERRED EMBODIMENTS

Figure 1:
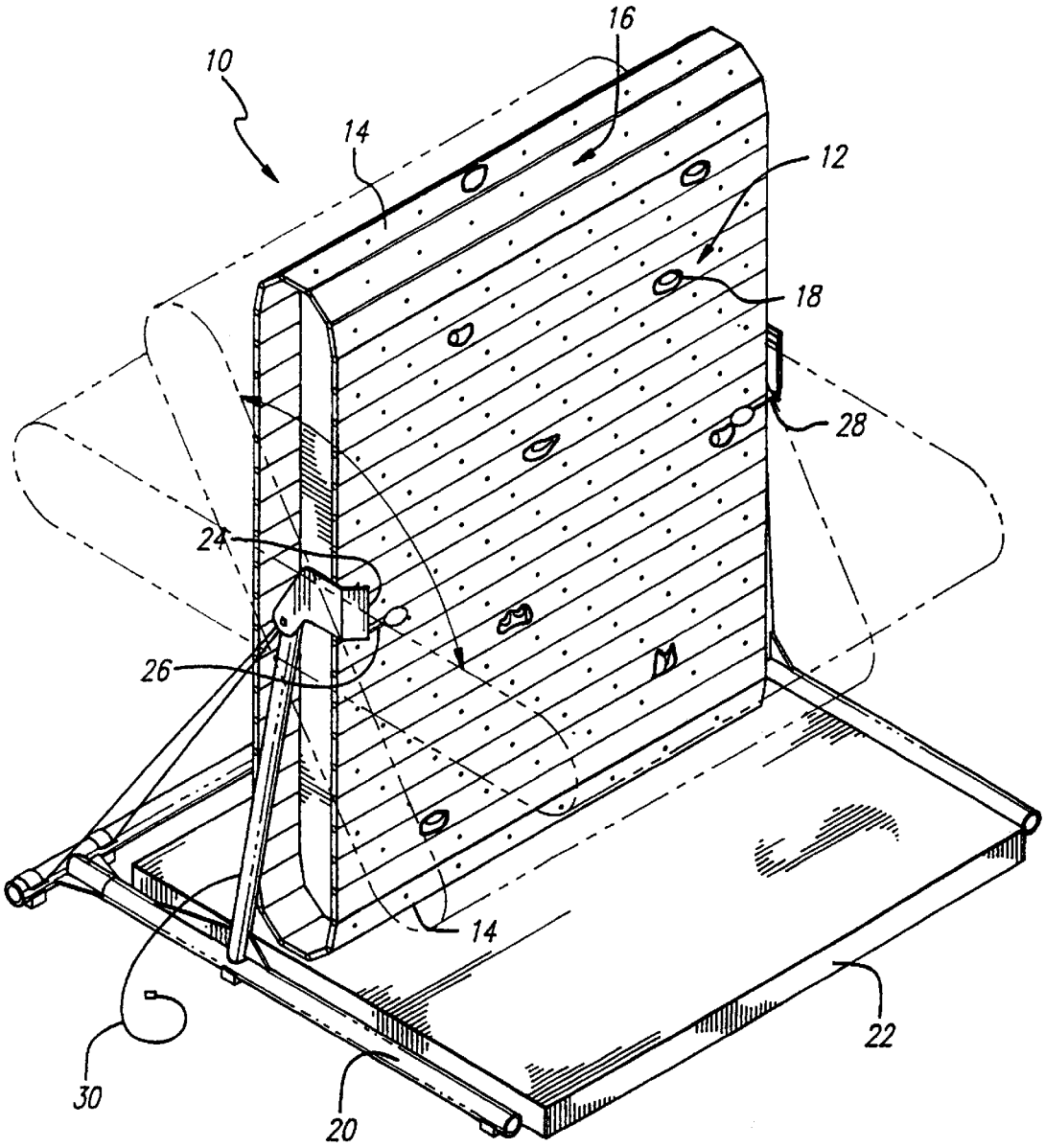
FIG. 1 is a perspective view of a climbing wall apparatus of the invention, showing various possible inclinations of a climbing wall surface in outline.

With reference to FIG. 1 of the drawings, which are given by way of example and not by way of limitation, a climbing wall apparatus 10 of the invention includes a continuous climbing surface 12 comprising rotatably interconnected extruded aluminum panels 14 having receptacles 16 for releasably receiving climbing hold fixtures 18 of various configurations. The nature and placement of the hold fixtures can be varied between climbs to provide more variation of the climbing surface in training. The climbing surface is carried by an inner frame (not shown) pivotably supported by an outer frame 20. A cushioned mat 22 is provided to cushion the impact of a climber's body as a result of a fall. A control panel 24 is provided adjacent the wall surface for convenient access, including access by a climber on the wall surface 12. Additionally two emergency stop pads 26, 28 are provided which when moved stop the rotation of the wall surface. Power is provided via a power cord 30 of conventional configuration.

The control panel 24 allows a user climbing on the trainer to reach over and adjust the inclination of the wall surface and the speed of the wall surface. The control panel also includes an indication of the "height" climbed which is a resetable measurement of the distance the wall surface has moved. The control panel is electrically connected to a conventional controller (not shown) which controls the speed and direction of drive motors which actuate the climbing wall apparatus of the climbing trainer. The controller employs a 8051 microprocessor and can also include RAM and ROM memory.

Figure 2:
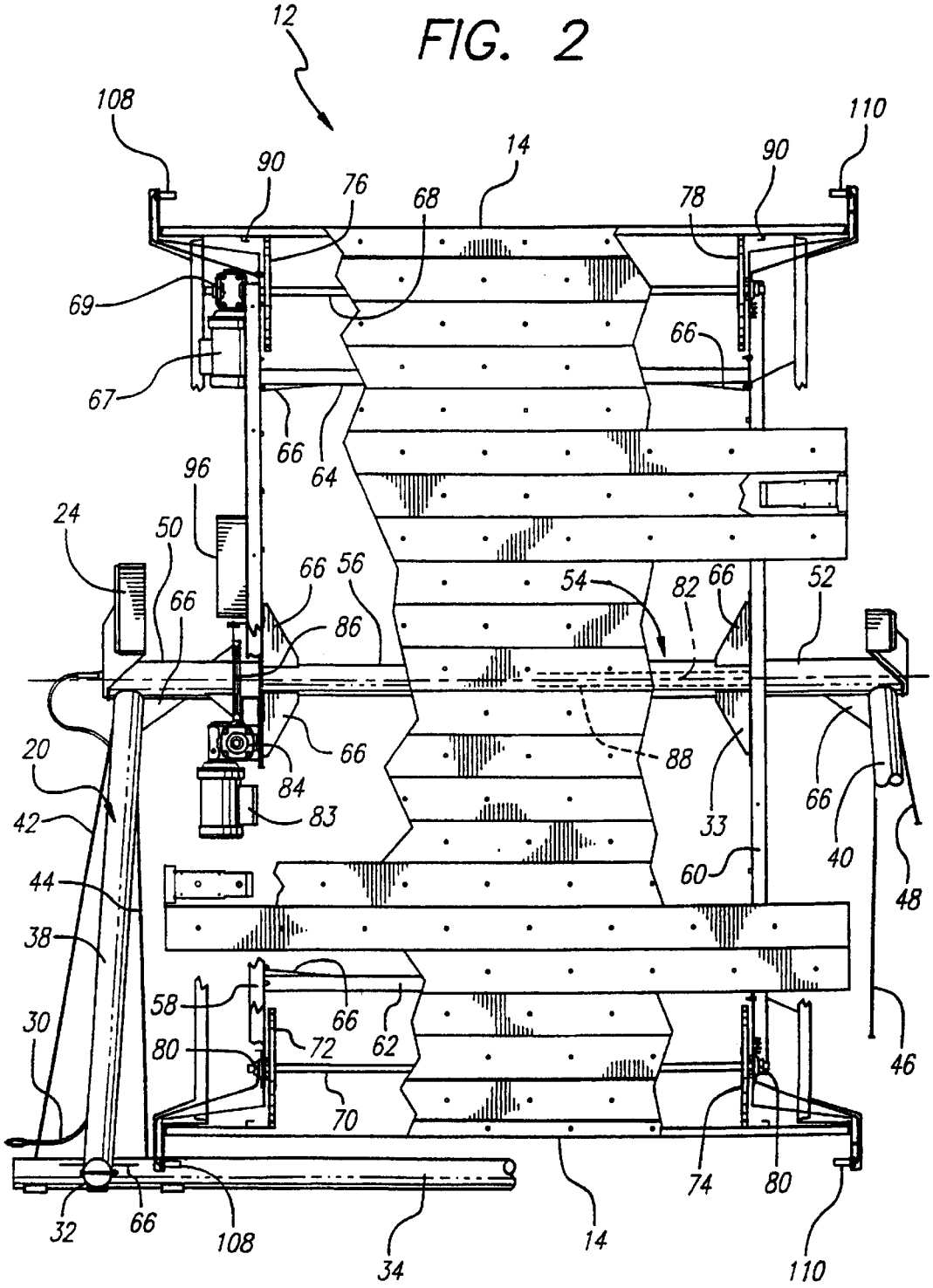
FIG. 2 is an elevational view, partly in section, of the apparatus of FIG. 1.
Figure 3:
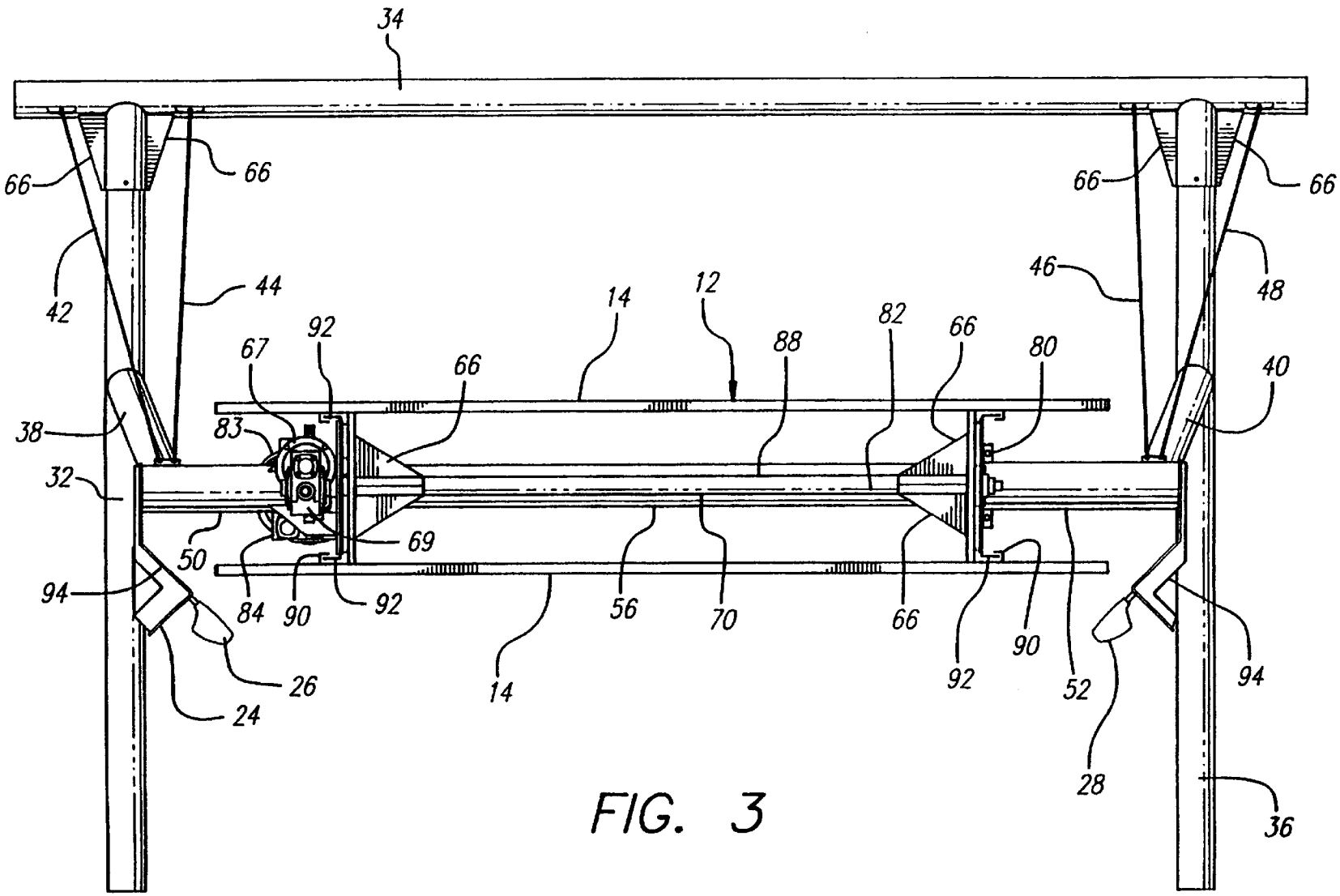
FIG. 3 is a view from above, partially in section, of the climbing apparatus of FIG. 1.
Figure 4:
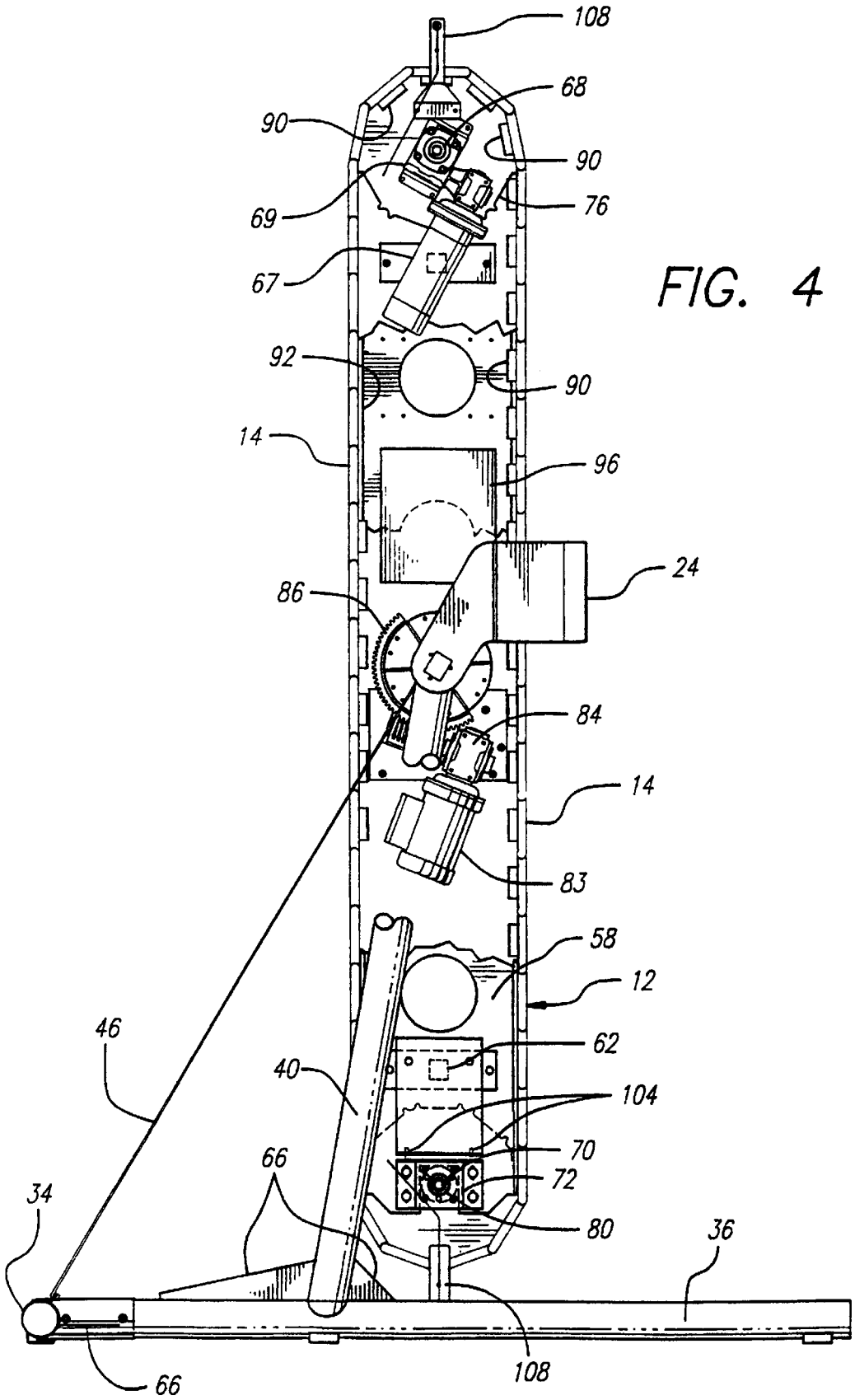
FIG. 4 is a side elevational view, partially in section, of the climbing trainer of FIG. 1.
Figure 5:
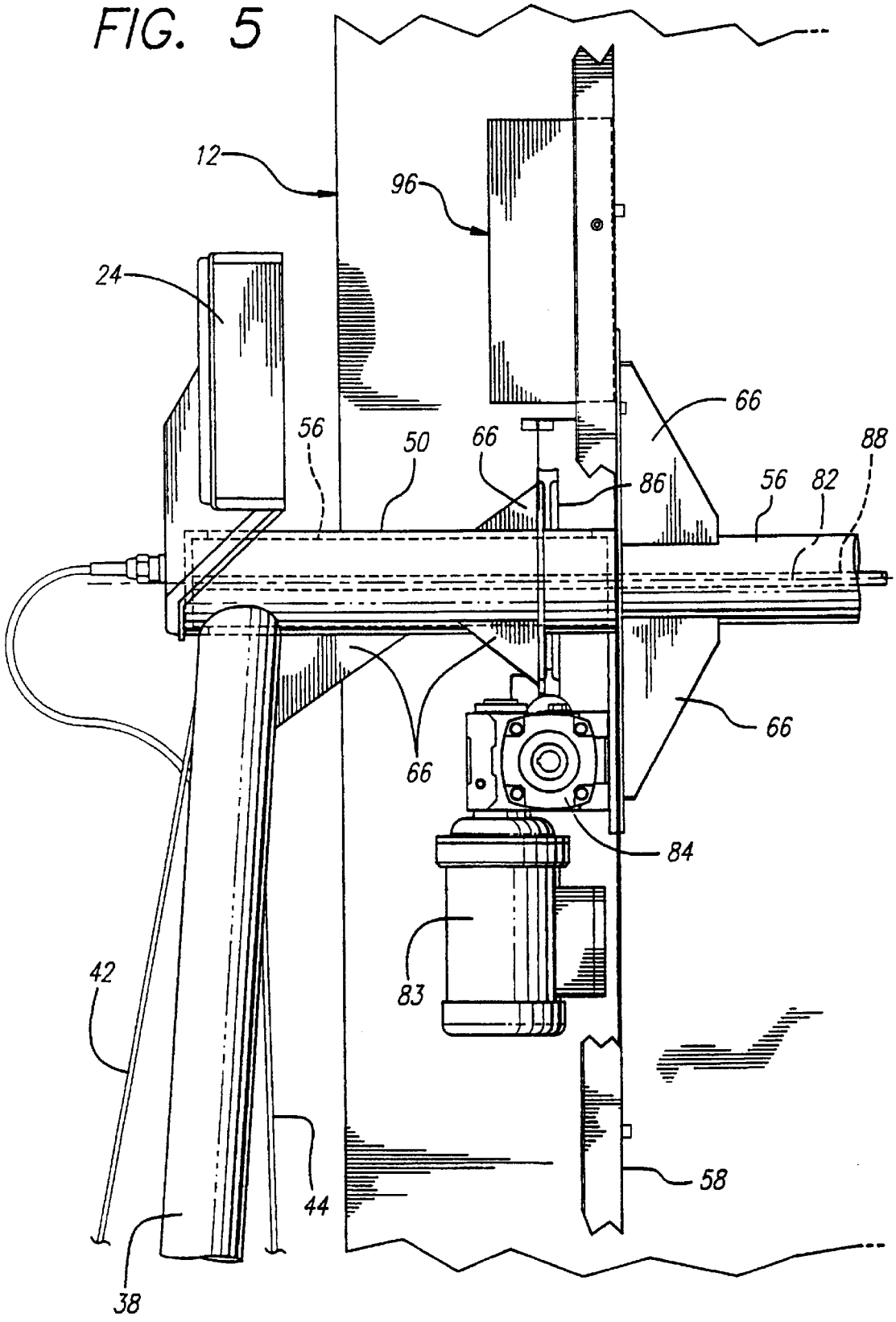
FIG. 5 is a more detailed front elevational view, partially in section, of a portion of the climbing trainer shown in FIG. 2.
Figure 6:
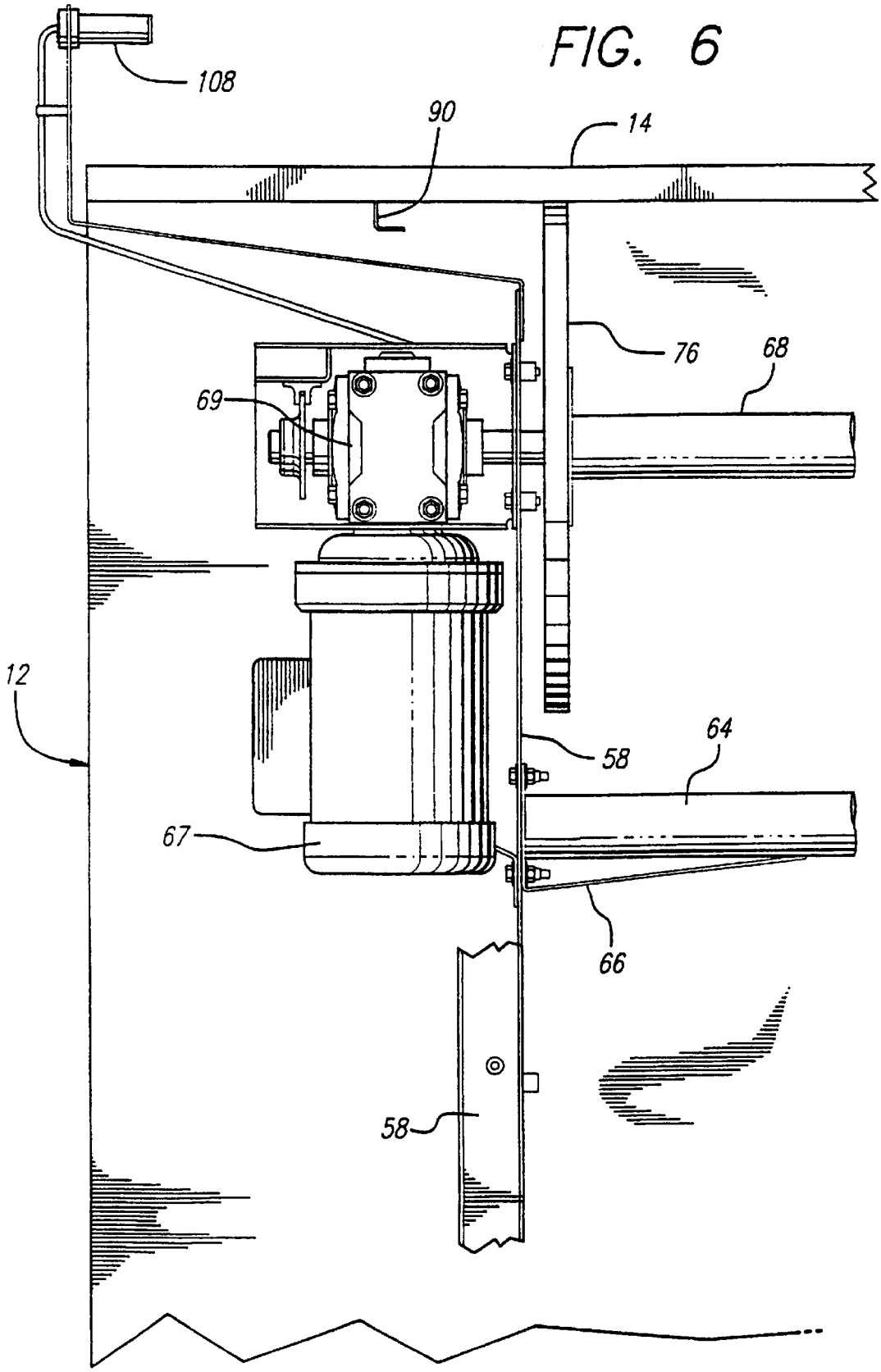
FIG. 6 is a more detailed front elevational view, partially in section, of a portion of the climbing trainer shown in FIG. 2.
Figure 7:
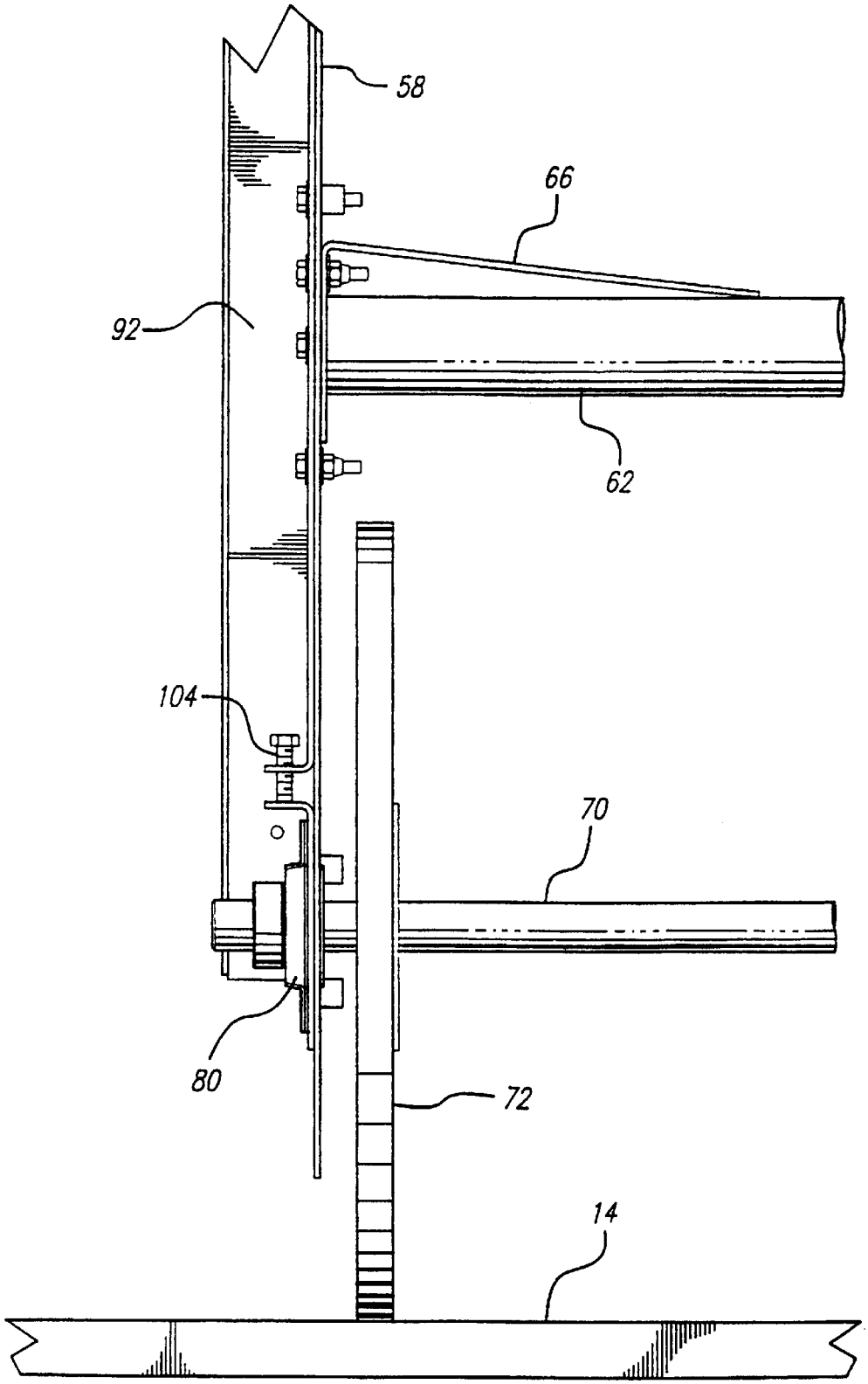
FIG. 7 is a more detailed front elevational view, partially in section, of a portion of the climbing trainer shown in FIG. 2.
Figure 8:
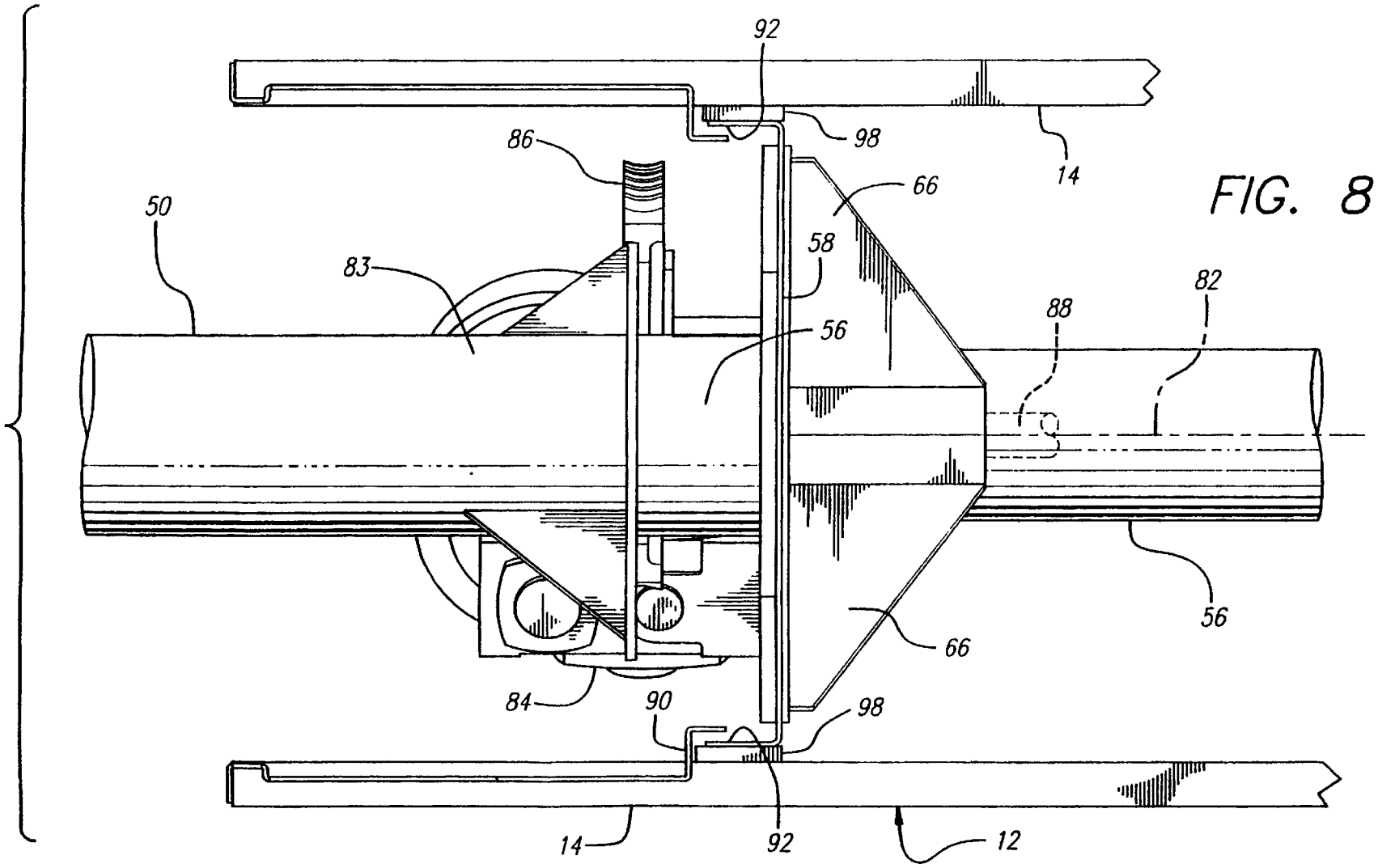
FIG. 8 is a more detailed top view, partially in section, of a portion of the climbing trainer shown in FIG. 3 showing particularly the worm gear drive motor and drive assembly and fixed center gear actuating rotation of the inner frame.

With reference to FIGS. 2, 3, and 4, the outer frame includes tubular steel members 32, 34, 36 comprising a base, 38 and 40 comprising risers, and adjustable tension members 42, 44, 46, 48. The risers support stationary horizontal steel tubular members 50, 52, which in turn rotatabley support the inner frame 54. The inner frame comprises a central rotating tubular member 56 formed of steel, side members 58, 60 and cross members 62 and 64. Braces 66 are used at points where frame members meet to provide increased rigidity. Horizontal axles 68, 70 are rotatabley supported by the side members adjacent the outer ends thereof. Axal 68 is driven by a drive motor 67 and gear assembly 69, while axal 70 is freely rotatable. Octagonal spindles 72, 74, 76, 78 disposed on the axles engage rotatably linked aluminum extruded panels 14 comprising a rotatable climbing surface 12. The linked panels form a continuous belt-like structure which rotates about the spindles. The distance between axles 70 and 68 is adjustable by means of adjustability in the location of bearings 80 supporting axle 70. The entire inner frame 54 and the continuous rotatable wall surface 12 formed of the linked panels 14 is rotatable about a horizontal central axis 82 by means of a worm gear drive motor 83 and worm gear assembly 84 mounted on the side member 58 of the inner frame. Affixed circular gear 86 fixedly carried by the horizontal tubular sleeve 50 cooperates with the worm gear drive assembly to provide adjustability in the rotational position of the inner frame with respect to the horizontal central axis 82 and the outer frame 20. A central tension member 88 coaxial with the central axis 82 extends through the interior of horizontal tubular member 56 to increase rigidity of the outer frame and cooperates with the inner frame to provide this effect.

The panels 14 are guided and supported by the inner frame 54 by guide members 90 attached to the panels 14 which slidably engage and travel along the inner frame side members 58, 60 by cooperation with an outwardly extending flange 92 incorporated in the inner frame side members. Low friction materials such as lubricous polymer resin, Teflon, or the like can be attached to the inner frame at points where the guide members slidably engage and contact it. This configuration prevents the panels forming the continuous wall from separating from the inner frame. This is very important when negative inclination is selected for the wall surface 12. A climber user's weight is supported in extreme negative inclination (horizontal) entirely by the guide members 90 slidably carried by the frame members 58, 60 at that position of the inner frame.

A control panel 24 is supported by the outer frame as before mentioned, as are emergency stop pads 26, 28 and the switches 94 actuated thereby which cut all power to all drive motors 69, 83. Further control electronics 96 are mounted on inner frame member 58. Rotation of the inner frame with respect to the inner frame being limited, flexible cables (not shown) can be employed in electrical connections between the control panel 24, power cord 30, emergency stop pad switches 94 and the further control electronics and drive motors mounted on the inner frame.

Further details can be appreciated with reference to FIGS. 5, 6, 7, and 8. Particularly with reference to FIG. 8, blocks of lubricous material 98 are attached to the flange 92 of the inner frame side member 58.

Figure 9:
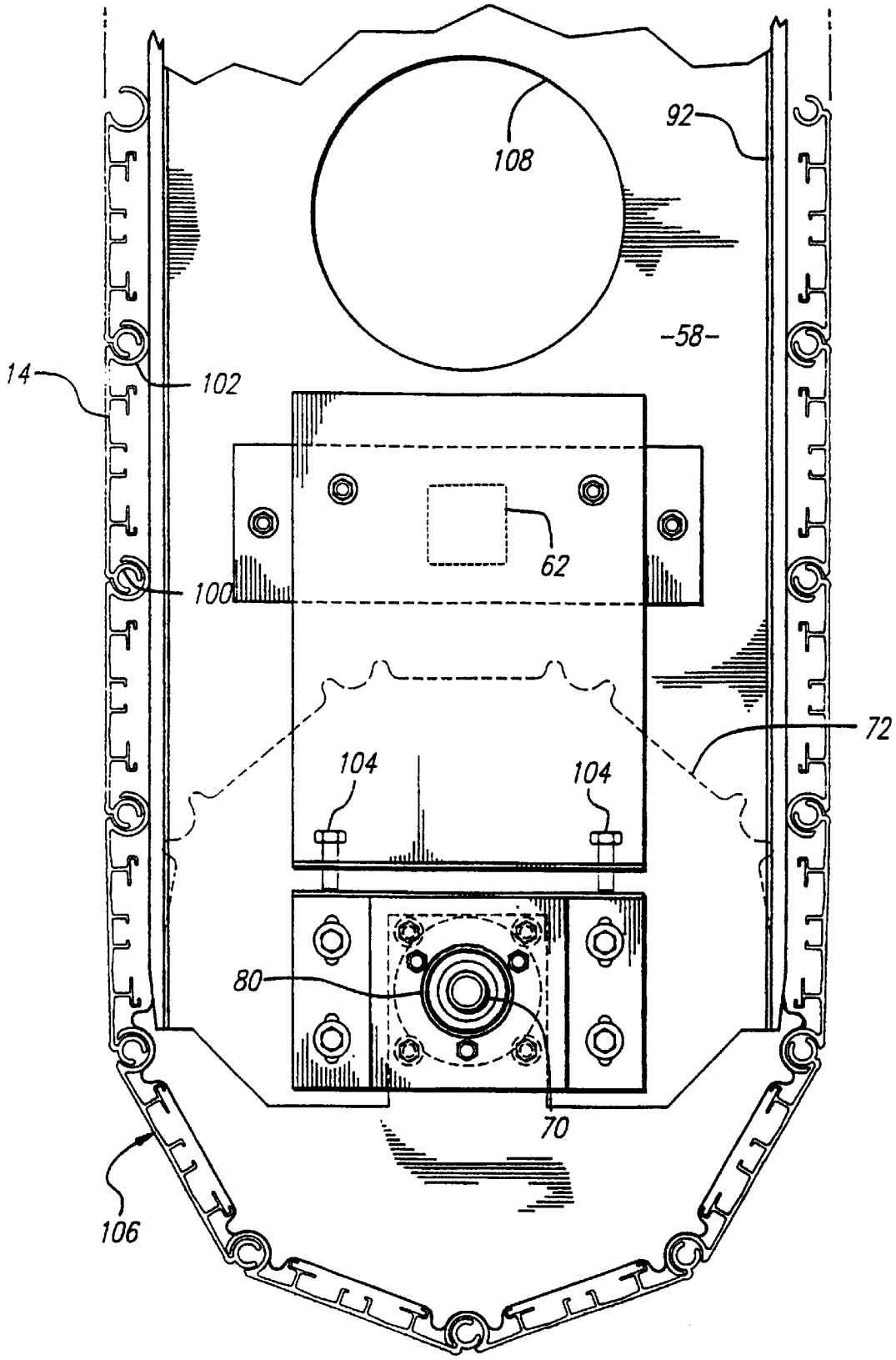
FIG. 9 is a more detailed side elevational view, partially in section, of a portion of the climbing trainer shown in FIG. 4.

Turning now to FIG. 9, details of the extruded aluminum panels 14 can be appreciated. Each panel comprises an inner hinge portion 100 and an outer hinge portion 102. Furthermore, the configuration of the panels are identical and cooperate with the octagonal spindle to provide smooth rotation. Adjustment bolts 104 allow adjustment of the tension of the continuous belt-like rotating wall 106 formed by the rotatably linked panels 14. With reference to FIGS. 9*a* and 9*b*, further details of the hinge connection between panels in one embodiment includes provision of a sleeve 101 of C-shaped cross-section between the inner hinge portion 100 and the outer hinge portion 102. As can be appreciated this gives smoother and quieter operation of the apparatus and reduces the need for lubrication between panels at the hinged connection between them. Also, the advantages in reducing pinching or catching clothes of the user of the panel configuration is more clearly shown. As can be appreciated, as the hinge rotates between limits of rotational motion shown in FIGS. 9*a* and 9*b* the configuration of the extruded panels 14 at the hinge connection between them does no allow an object or flesh of the user or others to be caught due to the very shallow depth of an indentation 103 which widens and narrows and the beveled configuration of the panels 14 where they form the indentation 103 adjacent the inner and outer hinge portion 100, 102 when the panels are assembled to form the belt-like rotating wall 106.

With reference again to FIG. 9 The belt-like rotating wall is carried on the inner frame members 58 and 60 and held thereto by interaction of guide members 90 and the flange 92 discussed above. Openings 108 are provided in the inner frame members to save weight in the members (58 is shown).

Figure 10:
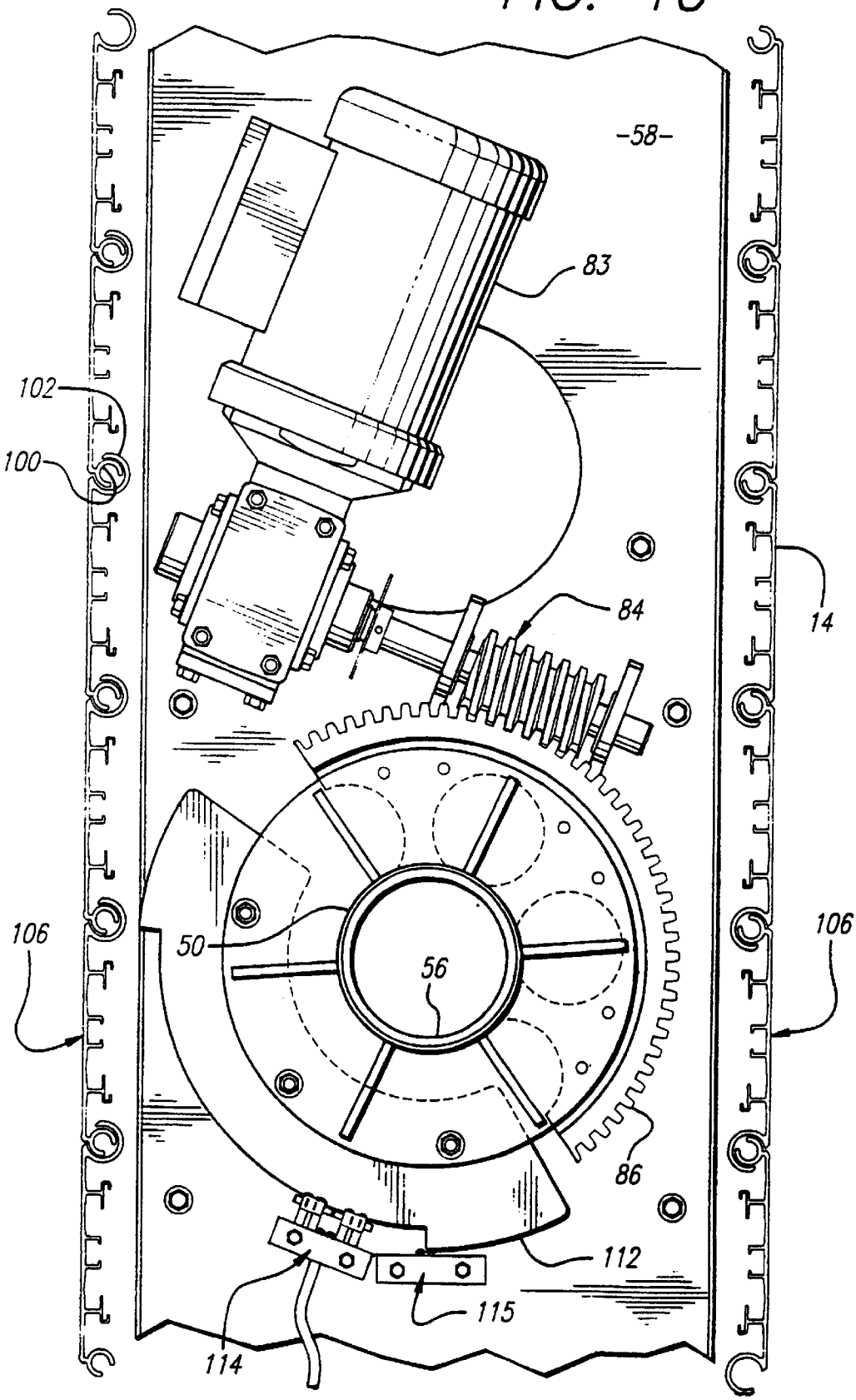
FIG. 10 is a more detailed side elevational view, partially in section, of a portion of an alternate embodiment of the climbing trainer shown in FIG. 4.

With reference to FIG. 10, in another embodiment a worm gear drive motor 83 and worm gear assembly 84 is mounted 180 degrees with respect to the axis of rotation of the wall surface from that shown in the previous figures. Also, a drive motor 67 and gear assembly 69 for actuating the rotating wall surface formed by the continuous belt-like interlinked panel assembly is moved from the top spindle 68 to the bottom spindle 70 in this embodiment. This lowers the center of gravity. The configuration of drive assemblies 67, 69, 83, 84 in this embodiment is advantageous in that the inner frame 54 of the wall assembly tends to rotate to a vertical position, and accordingly if the worm drive gear assembly is disengaged so that the inner frame of the wall assembly can freely rotate, it will move to a vertical position and remain there. This is helpful in manufacturing, but also, when a user is climbing on the wall surface less strain overall on the worm drive assemblies results from this juxtaposition of drive assemblies.

In one embodiment a sensor plate 112 is fixed to the stationary horizontal steel tubular member 50 along with the stationary circular gear 86. Sensors 114 cooperate with the sensor plate to provide a signal to the wall controller 96 concerning the angular position of the inner frame 54 to the outer frame 20, and accordingly its inclination with respect to vertical (or horizontal).

Referring to FIG. 2, in a further embodiment the climbing apparatus is provided with light sources 108 and photo sensors 110 at the top and bottom of the wall. This provides a signal when a beam of light from the source to the sensor in each case is interrupted. This signal can be used to control the wall to mitigate hazards to the user. For example in one embodiment the microprocessor of the wall controller 96 is programmed to respond to a signal that the beam between the light source 108 and sensor 110 on the bottom of the wall assembly has been broken by stopping the rotation of the wall surface. This is done as it may be that a person or object is positioned between the bottom of the rotating wall 106 and the mat 22. The microprocessor can be further programmed to respond to such a signal only when the bottom of the wall is within a selected distance of the mat (corresponding to a certain range of rotational angles of the wall from the vertical). In another embodiment if the light beam between the light source and sensor located at the top of the wall is broken the wall controller temporarily stops rotation of the wall surface and an audible warning may be given. This is to discourage users from climbing over the top of the wall apparatus when it is in motion. In these ways the risk of accident and injury to the user is lowered.

Figure 11A:
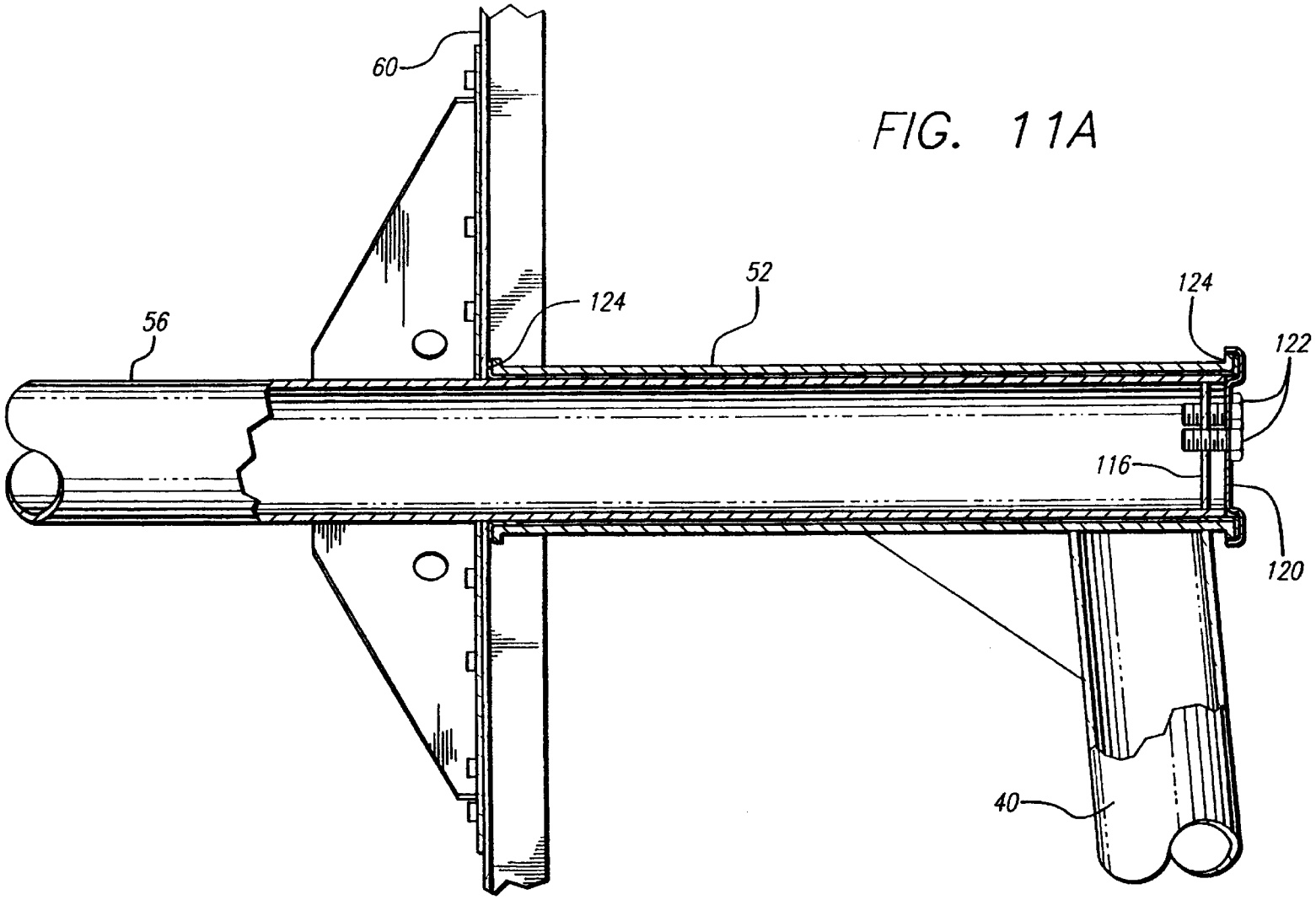
FIG. 11*a* is a more detailed front elevational view, partially in section, of a portion of an alternate embodiment of the climbing trainer shown in FIG. 2.
Figure 11B:
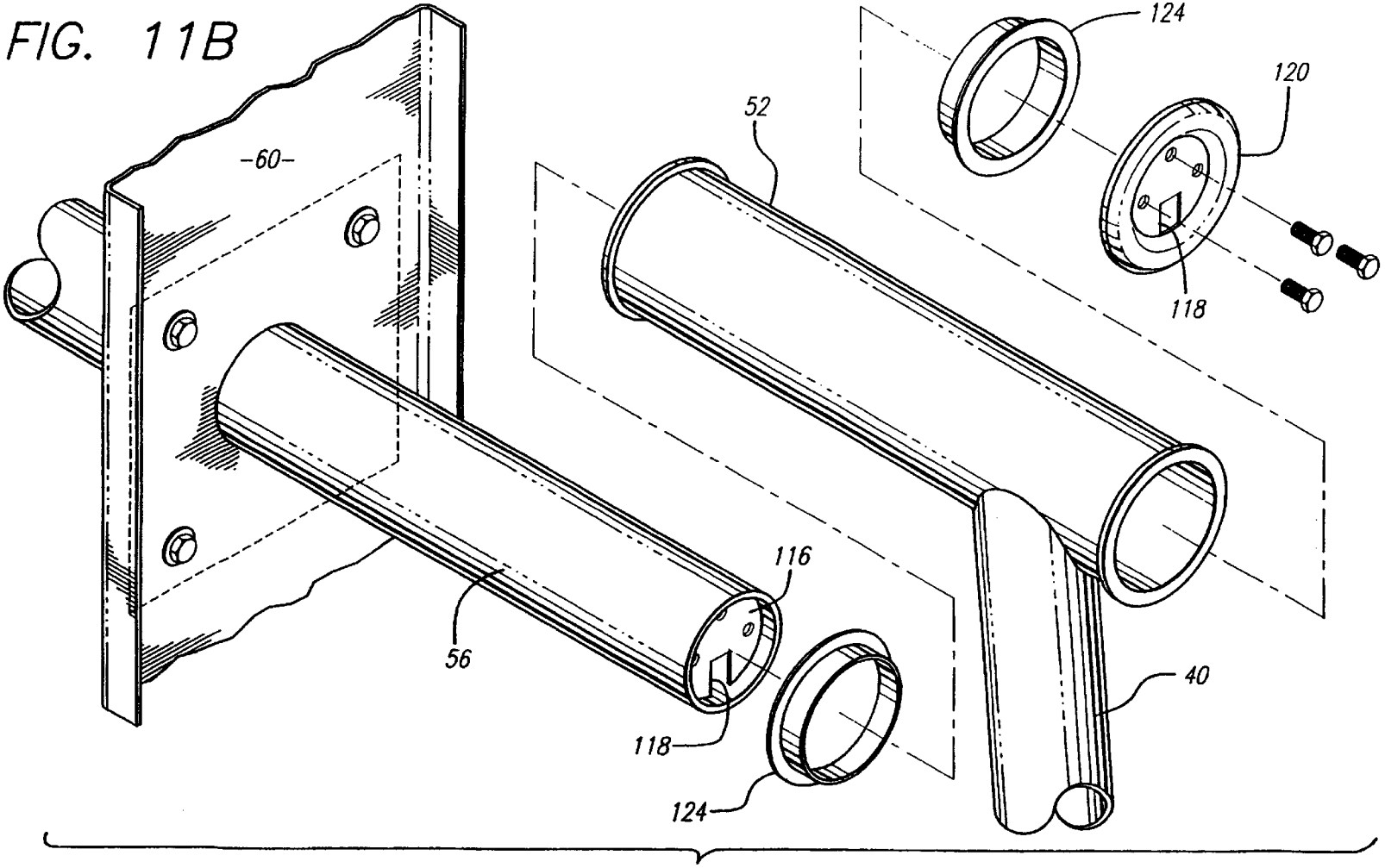
FIG. 11*b* is an exploded view of the detail shown in FIG. 11*a*.

With reference to FIGS. 11*a* and 11*b,* in another embodiment the central tension member 88 is eliminated in favor of the configuration shown. The central rotating tubular member 56 is retained in the stationary horizontal tubular member 52 by means of a plate 116 welded inside the central rotating tube 56 (having an opening 118 for passage of wiring and power cord, etc.) and an end cap 120 also having an opening 118 corresponding to that of the plate 116 which are bolted together by bolts 122. This arrangement ties the assembled structure together so that axial forces can be transmitted across the rotatable interconnection of elements 52 and 56. Sleeves 124 of lubricous material separate the central rotating member 56 and the horizontal tubular member 52 and provide for smooth relative rotation.

Figure 12:
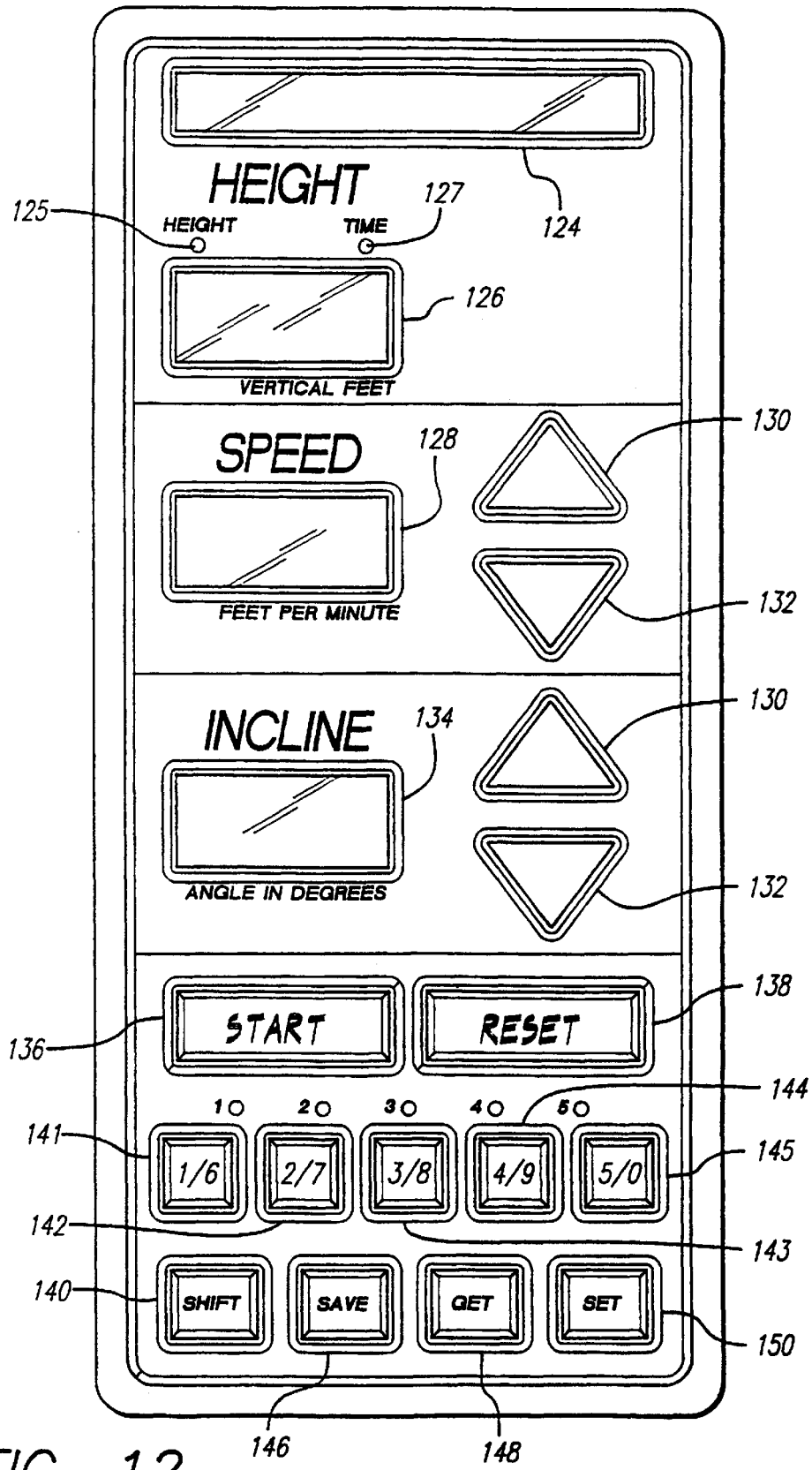
FIG. 12 is a front elevation view of a control panel of the climbing trainer shown in FIG. 1.

With reference to FIG. 12, a detail of the control panel 24 front face is illustrated. A liquid crystal display 124 allows alpha-numeric character display of information in operation of the system as described below in connection with FIGS. 13–15. Height and time of a climb or climb segment is displayed in a LED height time display 126. LEDs indicate height 125 or time 127. Speed of the rowing climbing wall surface 106 in vertical feet per minute is displayed in LED speed display 128. Speed can be manually adjusted by actuation of the up button 130 or down button 132 associated with speed. The incline of the wall surface is indicated in LED incline display 134. Adjustment of speed is manually possible using the associated up or down buttons. Start button 136 begins wall operation after initialization of the system. Reset button 138 re-initializes the system. Pre-programmed climbs can be accessed by depressing selection buttons 141, 142, 143, 144, or 145 or these in combination with a shift button 140. Each button is associated with two pre-programmed climb simulations and initiates one or the other depending on whether the shift button 140 was pressed beforehand. "Save," "get," and "set" buttons 146, 148, 150 respectively are used in storing and retrieving user defined climb simulations.

Figure 13:
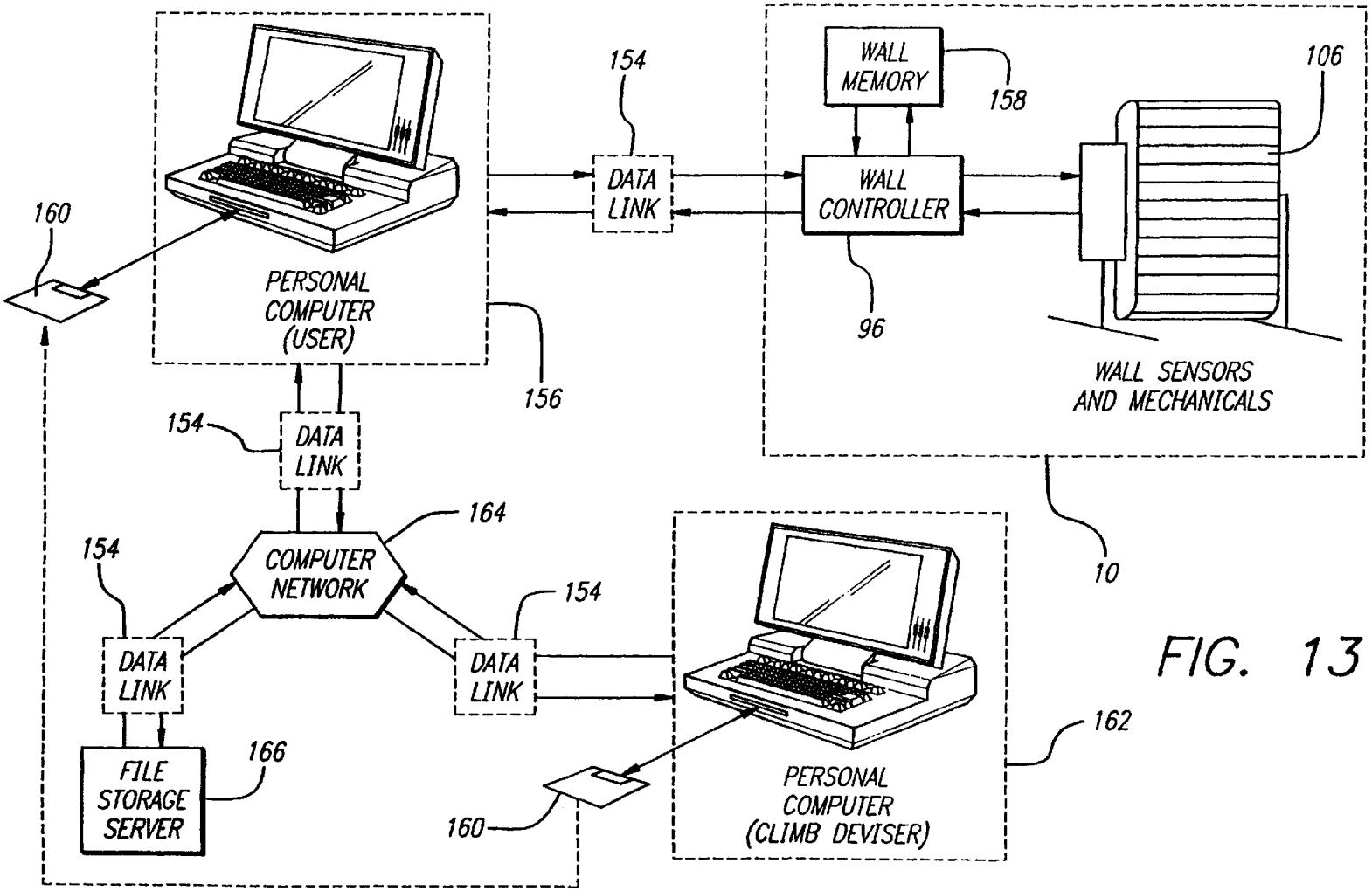
FIG. 13 is a block diagram of a climbing training system of the invention illustration interaction of various elements.
Figure 14:
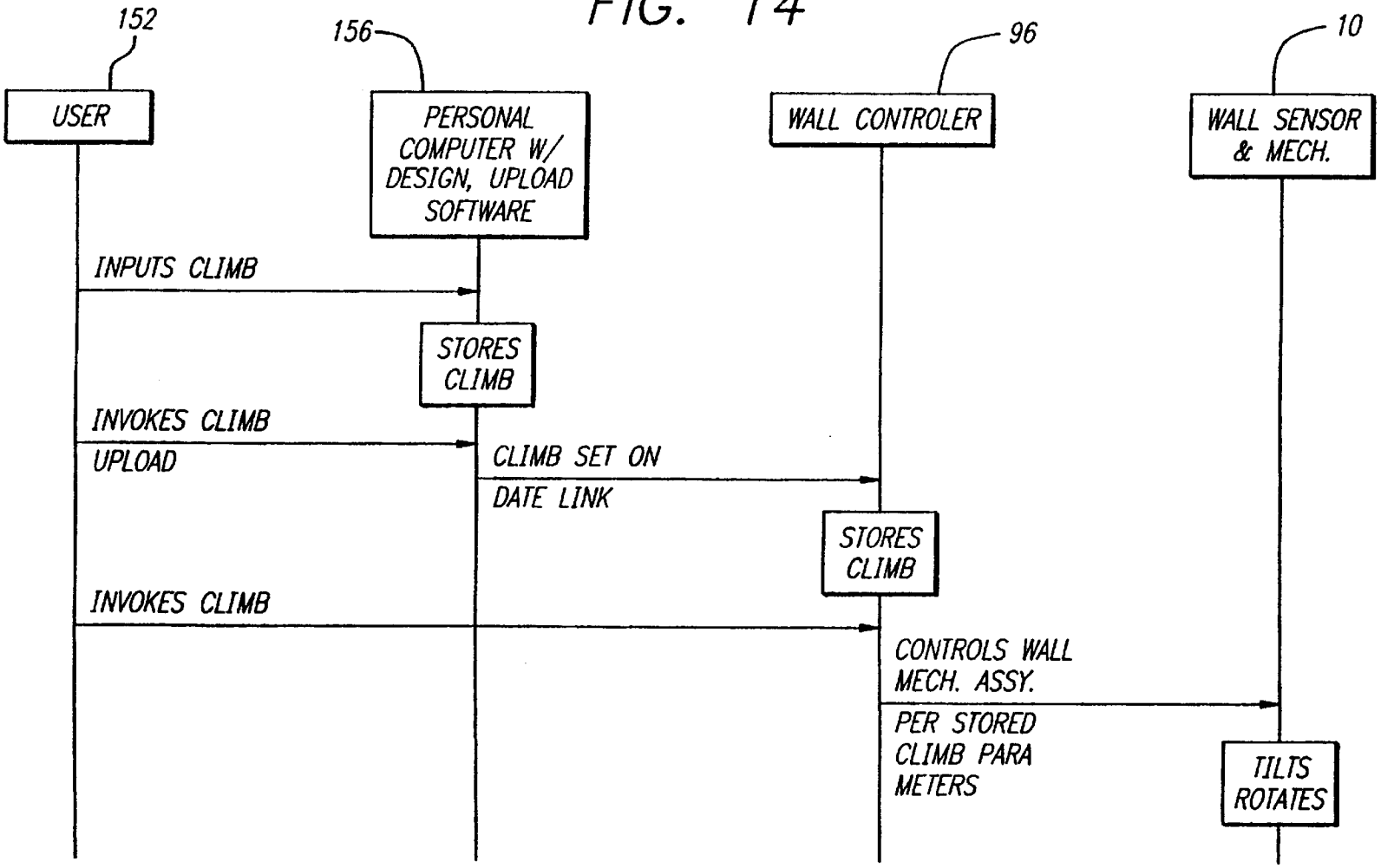
FIG. 14 is a time/logic diagram illustrating operation of one embodiment of the system shown in FIG. 13.
Figure 15:
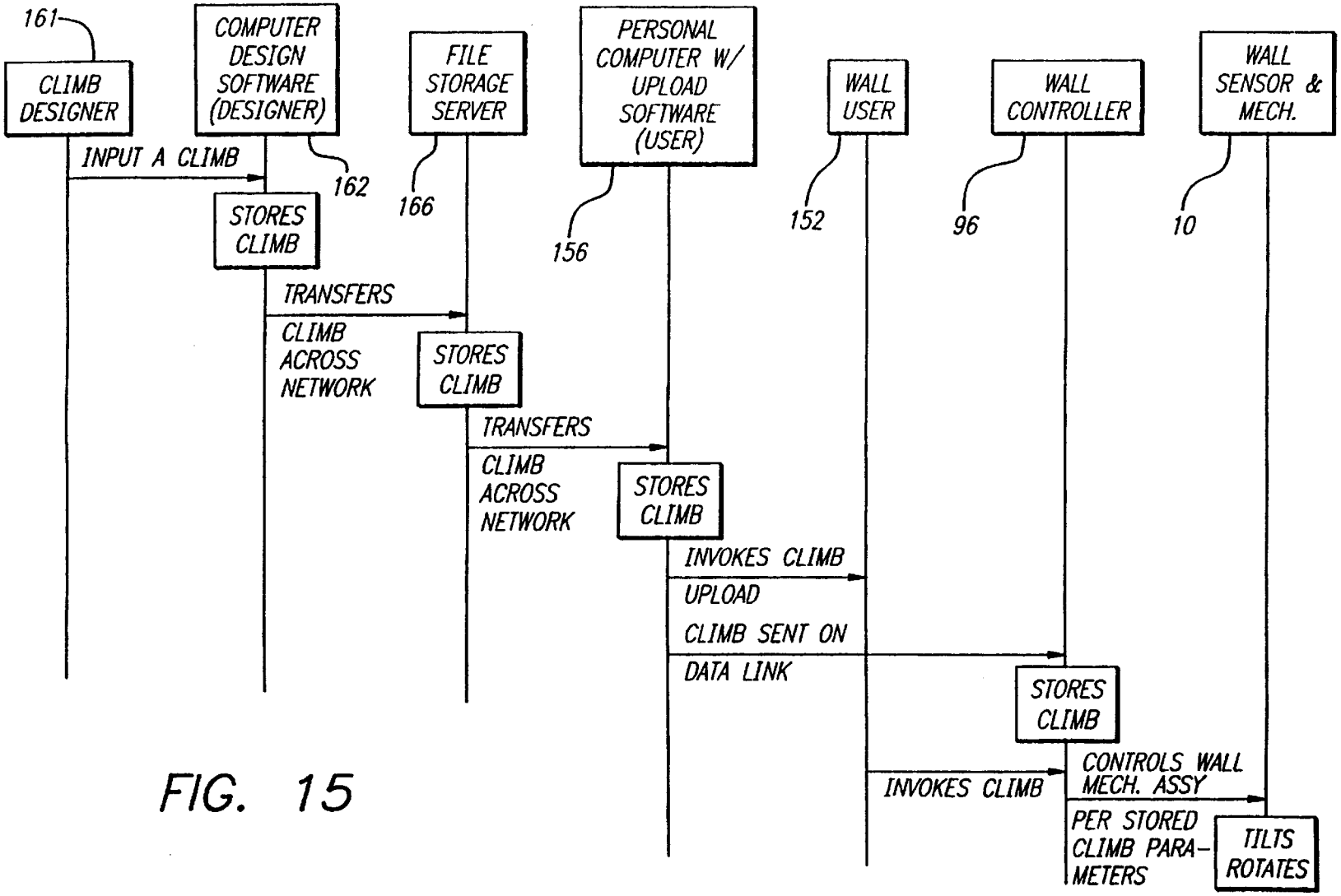
FIG. 15 is a time/logic diagram illustrating operation of another embodiment of the system shown in FIG. 13.

With reference to FIGS. 13 and 14 as well as 12, the electronic control of the speed of movement and inclination of the wall surface 106 allows pre-programmed climb simulations to be performed. For example, stored climbs may be accessed by a user 152 via the control panel 24 by pressing selection button 141, 142, 143, or 144 or one of these preceded by the shift button 140. The wall is provided in one embodiment with non-volatile memory wherein one or more instruction sequences for controlling the movement of the wall is stored. Pressing one of the pre-programmed climb buttons initiates a sequence of wall movements stored in such non-volatile memory. This is conventionally implemented using programmable microprocessors as discussed above.

A climb of various pitches of varied difficulty can thus be simulated. By variation of the angle of inclination, and variation speed of movement of the wall surface 106, climbing difficulty can be varied. Also, in one embodiment this can be further varied by using color coded holds of different configuration and placed on the wall surface so as to provide a variation in difficulty of negotiation from one color to another, for example. By controlling the wall so as to provide a fist simulated climb segment of a first degree of difficulty of a selected time duration and a second segment of a second time duration having a second degree of difficulty, and so on, a simulated climb of a selected time duration having variable difficulty over this time duration is provided. In one embodiment for example up to 15 climb segments can be provided, the time duration, inclination, speed of wall movement all being variable from one segment to the next. Moreover, the display 124 or an audible artificial voice can specify what color holds are to be used, adding a further parameter that can be varied from segment to segment. As will be appreciated by those skilled in the art this provides variation in training and can be accomplished without stopping the climb simulation to manually adjust the equipment. Due to the large range of angles of inclination (horizontal to 15 degrees past vertical in the presently preferred embodiment) large variations in degrees of difficulty due to vertical angle are possible.

In another embodiment the wall controller 96 is also provided with a data link 154 capability, such as a standard serial port for example to communicate with another device, such as a personal computer 156 (hereinafter PC) for example. Pre-programmed climbs in the form of a series of instructions for use by the microprocessor of the wall controller can be transferred to the wall controller from the PC. In a further embodiment the wall controller is provided with additional wall memory 158 which can accept and store data and which can be overwritten, and pre-programmed climbs can be transferred from the PC to the wall memory via the data link 154. In one embodiment this would constitute an additional capability beyond pre-programmed climbs stored in non-volatile memory used by the wall controller. The transferred pre-programmed climb can then be initiated from the control panel 24, for example by pressing a combination or sequence of buttons such as "shift" 140 and "get" 148 then "start" 136.

In one embodiment a PC 156 is connected to the wall controller 96 via a serial port and appropriate cabling and connectors (collectively 154). Software stored on the PC cooperates with that of the microprocessor of the wall controller 96 to allow the transfer of data comprising a pre-programmed climb simulation. In one embodiment the controller is programmed so that pressing the "shift" 140 and "set" 150 buttons simultaneously initiates the wall controller microprocessor to receive and store climb data. The display 124 shows "downloading" as a result. The user then initiates a download from the PC according to screen instructions on the PC. When the transfer is complete both the wall control panel display and the PC screen display "download complete" and the wall control panel subsequently displays "any key to continue". Pressing any key on the wall control panel then returns the wall controller to normal operation. Software on the PC to accomplish this sequence of operations is conventional, as is the programming of the wall controller microprocessor. The data link 154 can then be broken, for example by disconnecting the cable between serial ports. In one embodiment the newly downloaded climb is selected by pressing the "shift" and "get" 148 keys simultaneously. The simulation is started by pressing the "start" button. The display on the control panel can provide information about what stage (pitch) of the simulated climb the user is on during the simulation. As mentioned it can also display other information such as color of holds to be used to further vary the climb simulation.

In one embodiment the user can design a customized climb simulation and then download it to the wall controller 96 microprocessor memory 158. By means of appropriate software on the PC 156 a user can be prompted to enter parameters for a simulated climb. The parameters for up to 15 climb segments (pitches) can be specified in one embodiment. For example in one embodiment for each segment the user is prompted to enter a speed value from 2 to 50 vertical feet per minute (fpm), an incline value form −90 (horizontal) to +15 (15 degrees beyond vertical), and a vertical distance of 1 to 255 feet. When the user has defined as many of the 15 segments as desired the designed climb can then be stored in wall controller memory 158 by transfer of the data from the PC to the wall memory as described above.

As can be appreciated the software of the PC 156 and the microprocessor of the wall controller 96 can also be programmed to allow transfer of data from the PC to the wall controller to change the wall inclination and speed in real time effectively controlling the movement of the wall from the PC. This allows the relatively greater storage capacity of the memory of a PC to be used to store even more climb simulations which can be readily accessed and used. As will be appreciated the programming required is not extraordinary and conventional microprocessors and memory commercially available from a wide variety of sources throughout the world can be utilized in the wall controller to implement the invention as described herein. In one embodiment an 8051 microprocessor widely commercially available from a variety of vendors is used.

In a further embodiment the preprogrammed climb simulation can be delivered to the PC 156 via a data storage means such as a diskette 160. As can be appreciated such a climb program can be designed and programmed at one site by a climb designer 161 on a designer's PC 162 then sent to another for use. In one embodiment a climb simulation instruction sequence stored on disk and designed for use with a PC 156 connectable to the wall controller as described above also includes additional information about a real or imaginary climbing route the climb simulation emulates. For example, a route map showing a route up a real or imaginary mountain or particular feature such as a spire or face for example can be included. The pitches with the difficulty of each is shown. The climb simulation is designed to provide segments of length and difficulty similar to the real or imaginary route shown. The additional information is displayable on the screen of the PC 156 for the user's edification. The user's perception of the climb simulation as one actually training the user for climbing is thereby enhanced and the training experience of the user of the apparatus is thereby improved.

Moreover, in another embodiment the pre-programmed climb simulation is delivered to the apparatus via a computer network 164. As can be appreciated this is similar to the delivery just described but for the substitution of a line or wireless connection (collectively 154) of the PC to a network (including for example a global computer network generally referred to as the Internet). Given that the PC 156 is provided with a modem for a data link 154 with the Internet and a climb designer PC 162 is similarly equipped and connected, the climb simulation can be conventionally stored on a storage device in the computer network and likewise conventionally accessed by the user through the user's PC 156, for example.

Furthermore, the software in the PC 156 enabling data transfer can likewise be delivered via the Internet 164. This is advantageous in that the user can download software to enable new climbing simulations to be performed after purchase and installation of the apparatus 10, and improved software can be conveniently provided to users periodically by making such software available on a computer network, for example on a web site on the Internet. Moreover, these advantages can be obtained by the user 152 already having a PC 156 at minimal additional cost. By providing a data link 154 capability between the wall controller and a PC the advantages for convenient delivery of new climbing simulations and improved PC software related to new climbing simulations of computer networks such as the Internet are available to users. Accordingly, the system of the present invention is in effect upgradeable without additional expense for new control hardware.

Moreover, the capabilities of storing and receiving preprogrammed climb simulations, whether user-defined, preprogrammed in non-volatile memory, or provided from another site 162 via a memory device such as a diskette 160 or via a data link 154 over wire or wireless connection to another computer or computer network 164 for example, provide an enhanced training experience over that generally possible with conventional training apparatus. The capability of executing preprogrammed climbs delivered via the Internet, for example a "climb of the month" so delivered, allows increased variety in training and constitutes a large increase in capability for enhancing the training experience obtained through use of the methods, systems and apparatus set forth and described herein.

Persons skilled in the art will readily appreciate that various modifications can be made from the presently preferred embodiments of the invention disclosed herein and that the scope of protection is intended to be defined only by the limitations of the appended claims.

What is claimed is:

1. A powered exercise device comprising:

a support frame;

an exercise frame pivotably supported on the support frame for varying the inclination of said exercise frame relative to the support frame;

an exercise frame actuator connected to said exercise frame for tilting said exercise frame relative to said support frame;

a movable exercise surface mounted on said exercise frame for movement relative to said exercise frame;

a power drive connected to said exercise surface for moving said exercise surface relative to said exercise frame, the inclination of said exercise frame and exercise surface relative to said support frame being adjustable by said exercise frame actuator; and a computerized controller for controlling the speed of movement of said exercise surface and the pitch angle of said exercise frame, said controller comprising:

a memory programmed with data defining the parameters of a first simulated exercise;

a data link for transferring data defining the parameters of a second simulated exercise from a remote location to said memory;

a manually operable control panel for selecting a desired simulated exercise; and a visual display of parameters of the selected simulated exercise, said controller being operably connected to said actuator and to said power drive to control the speed of movement and inclination of said exercise surface in accordance with the desired simulated exercise.

2. The exercise device of claim 1, further comprising a safety kill switch actuatable by an individual exercising on said exercise surface for terminating movement of said exercise surface.

3. The exercise device of claim 2, further comprising a light source for generating a beam of light proximate said exercise surface and a photosensor for receiving said beam of light, said switch also being actuatable by a signal generated by said photosensor upon interruption of said beam of light.

4. The exercise device of claim 1, wherein said data is transferred via a computer network from a remote site.

5. The exercise device of claim 1, further comprising a personal computer containing said data defining the parameters of said second simulated exercise, said computer being connected to said controller via said data link.

6. The exercise device of claim 5, wherein said personal computer is connected to a computer network and said data is transferred to said personal computer via said network from a storage site located elsewhere on said network.

7. The exercise device of claim 6, wherein said exercise surface includes climbing holds theron and said data comprises a climb simulation having a plurality of segments of different difficulty by reason of variation of at least one parameter from a group of parameters consisting of speed of exercise surface movement and inclination of said exercise frame.

8. The exercise device of claim 7, wherein said segments in combination simulate an actual climbing route which has been mapped and for which difficulties of various segments have been determined.

9. The exercise device of claim 1, wherein said data link comprises a personal computer and means for connecting said personal computer to a network.

10. The exercise device of claim 9, wherein said network is a global computer network.

11. The exercise device of claim 10, wherein said visual display includes displays of the duration and progress of the selected exercise.

* * * * *